US005981410A

United States Patent [19]

Hansen et al.

[11] Patent Number: 5,981,410

[45] Date of Patent: Nov. 9, 1999

[54] CELLULOSE-BINDING FIBRES

[75] Inventors: Pia Holm Hansen, Tistrup; Anne Monrad Larsen, Esbjerg, both of Denmark

[73] Assignee: Fibervisions A/S, Varde, Denmark

[21] Appl. No.: 09/056,875

[22] Filed: Apr. 8, 1998

Related U.S. Application Data

[60] Provisional application No. 60/043,278, Apr. 17, 1997.

[30] Foreign Application Priority Data

Apr. 8, 1997 [DK] Denmark ..... 0394/97

[51] Int. Cl.[6] ..... D04H 1/06

[52] U.S. Cl. ..... 442/361; 442/347; 442/353; 442/364

[58] Field of Search ..... 442/347, 353, 442/361, 364

[56] References Cited

U.S. PATENT DOCUMENTS 4,684,576 8/1987 Tabor et al. .
4,950,541 8/1990 Tabor et al. .

FOREIGN PATENT DOCUMENTS

0421734A2 4/1991 European Pat. Off. .
0465203A1 1/1992 European Pat. Off. .
0019950A1 12/1980 France .
195 06 083 A1 7/1995 Germany .
54-030929 3/1979 Japan .
2-112415 4/1990 Japan .

*Primary Examiner*—Marion McCamish
*Assistant Examiner*—Arti R. Singh
*Attorney, Agent, or Firm*—Birch, Stewart, Kolasch & Birch, LLP

[57] ABSTRACT

The invention relates to drylaid nonwoven materials comprising bicomponent fibres comprising a low melting polyolefin component and a high melting polyolefin component, the low melting polyolefin component constituting at least a part of the surface of the fibre and comprising a non-grafted polyolefin component and a grafted polyolefin component, wherein the grafted polyolefin component has been grafted with an unsaturated dicarboxylic acid or an anhydride thereof, e.g. with maleic acid or maleic anhydride. The bicomponent fibres fibres have an excellent bonding affinity for natural fibres such as cellulose pulp fibres and allow the production of airlaid nonwovens with reduced generation of dust during the production process and with improved nonwoven strength properties.

24 Claims, No Drawings

CELLULOSE-BINDING FIBRES

This application claims benefit of Provisional Application Serial No. 60/043,278 filed Apr. 17, 1997.

FIELD OF THE INVENTION

The present invention relates to drylaid nonwoven materials comprising polyolefin bicomponent fibres having excellent bonding affinity for natural fibres such as cellulose fibres.

BACKGROUND OF THE INVENTION

Hygienic absorbent products such as disposable diapers contain, in addition to a water-permeable coverstock, a water-impermeable backsheet and one or more layers for distribution of liquid, an absorbent core typically comprising natural fibres such as cellulose fluff pulp fibres, synthetic fibres based on e.g. polyolefin and/or polyester and a superabsorbent polymer (SAP) material. In absorbent cores of this type, the synthetic fibres, which often are bicomponent fibres of e.g. polypropylene/polyethylene or polyester/polyethylene, are thermobonded to each other to form a supporting network for the core. Ideally, the synthetic fibres should be able to not only bond to each other, but also to the natural fibres and the SAP, so as to result in a core structure which is as strong and coherent as possible, and in which the natural fibres and the SAP are locked into place within the structure.

However, the existing synthetic fibres that are used for the production of drylaid, e.g. airlaid, nonwovens suffer from the disadvantage of suboptimal bonding to e.g. cellulose fibres. The problem is made worse by the fact that the natural fibres are typically relatively short, e.g. fluff pulp fibres with a length of not more than about 3 mm, as compared to the synthetic fibres, which are normally (although not necessarily) considerably longer. As a result, dust problems are created in the manufacturing process, and the performance of the resulting nonwovens is also suboptimal, since a large proportion of the natural fibres is not bonded to any of the synthetic fibres or otherwise held in place by means of the structure formed by bonding of the synthetic fibres.

It is therefore an object of the present invention to provide a bicomponent synthetic fibre which has an improved bonding affinity for natural fibres such as cellulose fluff pulp fibres and which therefore is particularly suitable for the production of drylaid nonwovens comprising a mixture of synthetic fibres and natural fibres.

EP 0465203-B1 discloses thermally bonded fibrous wet laid webs containing bicomponent fibres comprising a first component of polyester, polyamide or polypropylene and a second component of linear low density polyethylene (LLDPE) with a density of 0.88–0.945 g/cc and a grafted high density polyethylene (HDPE) with a density of 0.94–0.965 g/cc which has been grafted with maleic acid or maleic anhydride to provide succinic acid or succinic anhydride groups along the HDPE polymer.

EP 0421734-B1 discloses thermobondable bicomponent fibres composed of two different polyolefins having melting points which differ by at least 20° C., the lower melting polyolefin containing 3–10% by weight of a monoglyceride of a fatty acid of 12 or more carbon atoms incorporated therein. The fibres are reported to be easily processable without the need for an oiling agent to be applied during spinning or drawing.

U.S. Pat. No. 4,950,541 discloses succinic acid and succinic anhydride grafts of linear ethylene polymers obtained by grafting maleic acid or maleic anhydride onto a LDPE (low density polyethylene), LLDPE or HDPE polymer. The grafted polymers are dyeable and can be used e.g. as the sheath component of a bicomponent fibre.

U.S. Pat. No. 4,684,576 discloses the production of blends of grafted HDPE with ungrafted LLDPE or LDPE, the HDPE having been grafted with maleic acid or maleic anhydride to provide succinic acid or succinic anhydride groups along the HDPE polymer. The blends are disclosed for use in producing laminate structures.

It has now unexpectedly been found that polyolefin bicomponent fibres whose low melting component comprises a non-grafted polyolefin component and a grafted polyolefin component which has been grafted with an unsaturated dicarboxylic acid or an anhydride thereof have advantageous properties when used in the production of drylaid nonwoven materials, including improved bonding to cellulose pulp fibres and improved strength properties in the resulting nonwovens.

BRIEF DISCLOSURE OF THE INVENTION

In one aspect, the present invention relates to a drylaid nonwoven material comprising bicomponent fibres comprising a low melting polyolefin component and a high melting polyolefin component, wherein the low melting polyolefin component has a melting point at least 4° C. lower than the melting point of the high melting polyolefin component, the low melting polyolefin component constituting at least a part of the surface of the fibre and comprising a non-grafted polyolefin component and a grafted polyolefin component, wherein the grafted polyolefin component has been grafted with an unsaturated dicarboxylic acid or an anhydride thereof.

Another aspect of the invention relates to a method for producing a drylaid nonwoven material, comprising forming a fibrous web using dry lay nonwoven equipment, the web comprising bicomponent fibres comprising a low melting polyolefin component and a high melting polyolefin component, wherein the low melting polyolefin component has a melting point at least 4° C. lower than the melting point of the high melting polyolefin component, the low melting polyolefin component constituting at least a part of the surface of the fibre and comprising a non-grafted polyolefin component and a grafted polyolefin component, wherein the grafted polyolefin component has been grafted with an unsaturated dicarboxylic acid or an anhydride thereof, and bonding the fibrous web to result in the drylaid nonwoven material.

A further aspect of the invention relates to a bicomponent fibre as described above for the production of drylaid nonwoven materials.

DETAILED DISCLOSURE OF THE INVENTION

The term "polyolefin component" for the purpose of this invention means a polyolefin-containing polymeric material of which the largest part (by weight) consists of homo- or copolymers of monoolefins such as ethylene, propylene, 1-butene, 4-methyl-1-pentene, etc. Examples of such polymers are isotactic or syndiotactic polypropylene, polyethylenes of different densities, such as high density polyethylene, low density polyethylene and linear low density polyethylene and blends of the same. The polymeric material may be mixed with other non-polyolefin polymers such as polyamide or polyester, provided that polyolefins still constitute the largest part of the composition. The melts used to produce the polyolefin-containing fibres may also contain various conventional fibre additives, such as calcium stearate, antioxidants, process stabilizers, compatibilizers and pigments, including whiteners and colourants such as $TiO_2$, etc.

Although the present description will for the sake of simplicity generally refer to "fibres", i.e. cut staple fibres, it is to be understood that the present invention will also be applicable to the production of continuous polyolefin filaments, e.g. spunbonded filaments.

The term "drylaid" nonwoven refers to a nonwoven material produced by a dry process, including airlaid nonwovens, carded nonwovens, etc.

The bicomponent fibres may be of the sheath-core type with the core being located either eccentrically (off-center) or concentrically (substantially in the center), or of the side-by-side type, in which each of the two components typically has a semi-circle cross section. Bicomponent fibres having irregular fibre profiles are also contemplated, e.g. an oval, ellipse, delta, star, multilobal, or other irregular cross section, as well as splittable fibres. The bicomponent fibres will typically have a high melting and low melting polyolefin component which comprise, respectively, polypropylene/polyethylene (the polyethylene comprising HDPE, LDPE and/or LLDPE), high density polyethylene/linear low density polyethylene, polypropylene random copolymer/polyethylene, or polypropylene/polypropylene random copolymer.

In certain cases, e.g. when the two components of the fibres comprise high density polyethylene/linear low density polyethylene or polypropylene/polypropylene random copolymer, the difference in melting points between the two polyolefin components may be quite small, e.g. about 7–8° C. and in some cases even as low as about 4–5° C. However, it is generally preferred that the two components have melting points which differ by at least about 20° C., preferably at least about 25° C., more preferably at least about 28° C., e.g. at least about 30° C.

As mentioned above, a presently preferred aspect of the invention relates to a drylaid nonwoven material containing polyolefin bicomponent fibres in which the low melting polyolefin component comprises a non-grafted component and a grafted component, the grafted component having been grafted with an unsaturated dicarboxylic acid or an anhydride thereof. Examples of such acids and anhydrides are maleic acid, maleic anhydride and derivatives thereof such as citraconic acid, citraconic anhydride and pyrocinchonic anhydride; fumaric acid and derivatives thereof; unsaturated derivatives of malonic acid such as 3-butene-1, 1-dicarboxylic acid, benzylidene malonic acid and isopropylidene malonic acid; and unsaturated derivatives of succinic acid such as itaconic acid and itaconic anhydride.

Maleic acid and maleic anhydride are particularly preferred as the dicarboxylic acid or anhydride thereof. When these compounds are grafted onto a polyolefin chain, the resulting chain is provided with succinic acid or succinic anhydride groups, respectively, grafted onto it. The grafting of the dicarboxylic acid or anhydride thereof onto the polyolefin may be performed in a manner that is known per se, see e.g. the above-mentioned EP 0465203, U.S. Pat. No. 4,950,541 and U.S. Pat. No. 4,684,576.

The weight ratio of grafted polyolefin to non-grafted polyolefin in the low melting polyolefin component of the bicomponent fibres will be within the range of about 1:99 to 50:50, typically about 1.5:98.5 to 30:70, more typically about 2:98 to 20:80, e.g. about 3:97 to 15:85, such as about 5:95 to 10:90.

Within the grafted polyolefin, the content of carboxylic acid or anhydride thereof is typically in the range of about 1–30% (by weight), typically about 2–20%, more typically about 3–15%, such as about 5–10%.

The weight ratio between the high melting and low melting polyolefin components will be in the range of from 10:90 to 90:10, typically about 20:80 to 80:20, more typically about 30:70 to 70:30, e.g. 35:65 to 65:35.

As mentioned above, drylaid nonwovens according to the invention comprising polyolefin bicomponent fibres and natural fibres may be characterised by an improved bonding of the bicomponent fibres to the natural fibres as determined by a standardised dust test whose result reflects the quality of the bonding between the two types of fibres. In this standardised test, drylaid nonwoven samples having a base weight of about 85 g/m$^2$ and a thickness of about 1.1 mm are prepared using a line speed of 20 or 40 m/min from a mixture of 25% by weight of the synthetic fibres being tested and 75% by weight of a cellulose pulp fibre (e.g. NB 416 from Weyerhauser). Nonwovens to be tested are generally prepared using a series of different bonding temperatures (e.g. using hot air or calender bonding, typically a hot air oven) in order to optimise the properties of a given nonwoven.

The determination of the dust value of a nonwoven is performed as follows. Before the measurement is carried out, the nonwoven samples to be tested are conditioned for at least 12 hours to ensure that all of the samples have been subjected to the same temperature and humidity conditions. Since, as described below, the results are often expressed as a relative value compared to a control, the exact temperature and relative humidity for the conditioning of the samples is not critical, as long as all samples to be compared have been subjected to the same conditions. Ambient temperature and humidity conditions may therefore be used. Prior to conditioning, the nonwovens are cut into individual samples with a size of 12×30 cm. After conditioning, a cardboard strip with a width of 5 mm is attached to the short sides of the sample, after which the sample with the attached cardboard strips is weighed on a laboratory scale with an accuracy of ±0.1 mg. The nonwoven sample to be tested is then fixed with two clamps having a length of 12 cm, each of which is mounted on an arm. The exposed area of the fixed nonwoven is about 310 cm$^2$, which is about the size of a piece of A4 paper. One of the arms is stationary, while the other arm is rotatable and is attached to a spring.

The test is performed by rotating the rotatable arm 45°, so that the nonwoven sample goes from a "stretched out" condition to a "relaxed" condition, after which the rotatable arm is released, whereby the action of the spring returns the rotatable arm to its original position. The movement of the arm is stopped by the nonwoven sample, which thus is subjected to a small vibration and stretching effect designed to be similar to the conditions a nonwoven roll is subjected to when it is unrolled at the converter, the vibration and stretching resulting in a loss of loose fibres at the fibre surface. This action is repeated 50 times. The stretching force the sample is subjected to must of course lie within the nonwoven's elasticity limit, so that the nonwoven is not substantially deformed or damaged during the test. For the same reason, and taking into consideration that the tensile strength of different nonwovens can vary considerably, the force provided by the spring must obviously be compatible with the nonwoven to be tested, so that the nonwoven is on the one hand returned to its original stretched out position and subjected to a slight vibration and stretching, but is on the other hand not excessively stretched so as to become deformed or damaged.

After having been subjected to the vibration/stretching action 50 times, the sample is again weighed, and the difference between the two values is calculated and expressed as mg of dust.

In this standardised dust test, the result in mg will often be no more than about 15 mg, typically no more than about 10 mg, preferably no more than about 5 mg, more preferably no more than about 4 mg, still more preferably no more than about 3 mg, most preferably no more than about 2 mg. For nonwovens with a particularly good affinity between the synthetic fibres and the natural fibres, the result can be as low as about 1 mg of dust.

An alternative and often preferred way of defining the dust-reducing properties of a given fibre in the standardised dust test is in terms of reduction of the amount of dust (in mg) in a standard nonwoven prepared from fibres of the invention compared to a similar nonwoven prepared from similar fibres without the grafted polyolefin component. In this case, the nonwoven prepared from the fibres of the invention should show a dust reduction of at least about 40% by weight compared to the control nonwoven prepared with the control fibres, typically at least about 50% by weight. Preferably, the dust reduction is at least about 60%, more preferably at least about 70%, and still more preferably at least about 80%. For fibres with particularly good cellulose-binding properties, the dust reduction can be as much as about 90% or more. Since the dust properties of a given nonwoven can vary greatly depending on factors such as the nature of the bicomponent fibres and the nature of the cellulose or other fibres as well as e.g. the particular web-forming and bonding process, it will often be preferred to compare the performance of a given fibre in terms of its dust reduction percentage compared to a similar control fibre rather than in terms of an absolute value in mg.

It is furthermore contemplated that the fibres of the invention will also show an improved bonding and fixation of not only cellulosic fibres but also different superabsorbent polymers (SAP) that are commonly used in hygiene absorbent products in the form of particles or fibres. Such SAPs, e.g. a crosslinked polyacrylic acid salt, are typically used in the form of superabsorbent particles in the absorbent core of e.g. disposable diapers, since they are able to absorb many times their weight in liquid and form a gel that holds onto the liquid upon wetting. Even if the fibres of the invention are not directly bonded to the SAP particles, it is contemplated that the improved bonding of the fibres of the invention to the cellulosic fibres will result in an improved structure that in itself serves to ensure that the SAP particles are maintained in the desired location in the absorbent product, whereby the function of the SAP will be improved.

The spinning of the fibres is preferably accomplished using conventional melt spinning (also known as "long spinning"), with spinning and stretching being performed in two separate steps. Alternatively, other means of manufacturing staple fibres, in particular "compact spinning", which is a one step operation, may be used to carry out the invention. Methods for the spinning of bicomponent fibres and filaments are well-known in the art. Such methods generally involve extrusion of the melts to produce filaments, cooling and drawing of the filaments, treatment of the filaments with an appropriate spin finish to result in desired surface properties, e.g. using a spin finish to provide hydrophilic properties when the fibres are to be used in an absorbent core and/or to provide antistatic properties, stretching the filaments, typically, treating with a second spin finish, texturizing the filaments, drying the filaments and cutting the filaments to result in staple fibres.

As indicated above, the drylaid nonwovens of the present invention typically comprise, in addition to the polyolefin bicomponent fibres, at least one additional fibrous material, in particular natural fibres or regenerated fibres, e.g. selected from cellulose fibres, viscose rayon fibres and Lyocell fibres. The cellulose fibres may e.g. be pulp fibres or cotton fibres and are in particular pulp fibres such as CTMP (chemi-thermo-mechanical pulp), sulfite pulp or kraft pulp.

The fibrous web comprising the bicomponent fibres and the additional fibrous material will typically comprise 5–50% by weight of the bicomponent fibres and 50–95% by weight of the additional fibrous material, more typically 10–40% by weight of the bicomponent fibres and 60–90% by weight of the additional fibrous material, e.g. 15–25% by weight of the bicomponent fibres and 75–85% by weight of the additional fibrous material.

EXAMPLES

Example 1

Trials were run with different polyolefin bicomponent fibres to evaluate their bondability to cellulose pulp fibres.

The cellulose fibres were NB 416 from Weyerhauser. The weight ratio of between the bicomponent fibres and the cellulose fibres was 25:75.

The tested bicomponent fibres had the following composition, fibre No. 1 being according to the present invention:

1: Core: polypropylene; sheath: 10% grafted LLDPE (5% maleic acid grafted onto 95% LLDPE), 90% LLDPE.
2. Control fibre; core: polypropylene; sheath: 100% LLDPE.
3. AL-Special-C from Danaklon A/S; polypropylene core, HDPE sheath.
4. Hercules 449 from Hercules Inc., length 5 mm, fineness 1.5 dtex; polypropylene core/polyethylene sheath.

Bicomponent fibres 1, 2 and 3 all had a fineness of 1.7 dtex, a length of 6 mm and a weight ratio between core and sheath of 35:65.

The fibres were run at a very low speed of 8.33 m/min on an airlaid apparatus (Dan-Web, Denmark), since the primary purpose of these trials was to determine the fibres' ability to bond to cellulose. During the trials, an airlaid nonwoven product having a basis weight of 80 g/m$^2$ was aimed at, and the trials were started at the lowest possible bonding temperature, after which the temperature in the oven was increased in increments of 5 or 10° C.

Results:

The cross direction (CD) dry strength, machine direction (MD) dry strength and MD wet strength were determined on samples produced at different temperatures as indicated below (EDANA test method No. 20.2-89, tested at a speed of 100 mm/min). Furthermore, the thickness and the basis weight (g/m$^2$) of each sample was determined, and this information (not listed below) was used to adjust the strength values to result in normalised values that are comparable in spite of minor differences in thickness and base weight of the individual samples tested. The results are shown below.

| Sample No. | Bonding Temp. ° C. | Strength MD N/5 cm | Strength CD N/5 cm | Strength MD, wet N/5 cm |
|---|---|---|---|---|
| 1 | 125 | 25.9 | 25.2 | 25.4 |
| 1 | 130 | 20.9 | 20.5 | 18.3 |
| 1 | 135 | 23.5 | 22.4 | 20.6 |
| 1 | 140 | 23.1 | 22.3 | 20.1 |
| 1 | 145 | 23.9 | 22.5 | 18.0 |
| 2 | 125 | 17.46 | 15.43 | 15.13 |
| 2 | 130 | 13.63 | 13.32 | 11.62 |
| 2 | 135 | 15.17 | 15.06 | 12.66 |
| 2 | 140 | 16.25 | 15.72 | 13.49 |
| 2 | 145 | 12.77 | 13.08 | 9.78 |
| 2 | 150 | 11.28 | 10.77 | 6.77 |
| 2 | 155 | 4.15 | 4.26 | 2.23 |
| 3 | 130 | 24.01 | 23.37 | 23.59 |
| 3 | 140 | 19.34 | 18.08 | 18.57 |
| 3 | 150 | 15.59 | 16.66 | 14.42 |
| 4 | 130 | 7.98 | 7.78 | 7.98 |
| 4 | 140 | 9.23 | 7.93 | 8.73 |
| 4 | 150 | 8.83 | 8.93 | 8.83 |
| 4 | 160 | 4.21 | 4.31 | 2.26 |
| 4 | 170 | 3.24 | 3.14 | 1.27 |

The results of the dust test were as follows (average of 2 trials, except for fibre No. 3, which is the range of results obtained in a larger number of test runs with this fibre):

| Fibre number | Dust (mg) |
|---|---|
| 1 | 1.7 |
| 2 | 7.4 |
| 3 | 12–30 |
| 4 | 14.0 |

Compared to the control PP/PE fibres 2, 3 and 4, fibre 1 according to the invention gave a significantly improved result in the dust test, the greatly reduced dust generation reflecting a significantly improved bonding of the bicomponent fibres of the invention to the cellulose fluff pulp fibres. Observation of the samples by microscope also revealed bonding of the bicomponent fibres of the invention to the cellulose fibres. It was also found that fibre 1 gave a bulkier nonwoven compared to fibres 2 and 3 (fibre 4 was not compared in this regard). Furthermore, as shown by the strength values given in the table above, the fibres of the invention resulted in nonwovens with improved strength and elongation characteristics.

Example 2

A test of the ability of two different fibres to bind cellulose was performed in a test on a commercial airlaid line. Airlaid nonwovens with a basis weight of about 80 g/m$^2$ and a thickness of about 1 mm were produced. The nonwovens contained 25% by weight of bicomponent fibres and 75% by weight of cellulose pulp fibres. The bicomponent fibres tested had a fineness of 1.7 dtex and a length of 6 mm. In addition to (control) fibre No. 3 described above, a bicomponent fibre (referred to as No. 5) with the same cellulose-binding additive as in fibre No. 1 but a higher melting polyethylene sheath component (HDPE) was tested. This fibre thus had the following composition:

5: Core: polypropylene; sheath: 10% grafted LLDPE (5% maleic acid grafted onto 95% LLDPE), 90% HDPE.

The individual nonwoven samples were bonded at different temperatures with intervals of 3° C. in order to ascertain the optimum bonding temperature for the individual fibres.

It was found that the nonwovens containing bicomponent fibres of the invention (fibre 5) resulted in an improved binding of the cellulose fibres as evidenced by a reduced generation of dust during processing compared to the control fibre (quantitative measurements were not performed in this case). Furthermore, the fibres of the invention resulted in nonwovens with improved strength characteristics as evidenced by the following test results:

| MD tensile strength, dry (N/5 cm) | | |
|---|---|---|
| Bonding | Fibre | |
| Temp. ° C. | Control | 5 |
| 137 | 13.96 | 15.08 |
| 140 | 15.77 | 19.01 |
| 143 | 12.56 | 19.40 |
| 146 | — | 15.41 |

Example 3

Tests were performed to illustrate the influence of varying the amount of additive (maleic acid grafted LLDPE with an active content of 5%) in the sheath component.

The bicomponent fibres tested all had a fineness of 1.7 dtex and a length of 6 mm. The core/sheath weight ratio for fibres 6–9 was 35:65, and 50:50 for fibre No. 10. The core was in all cases of polypropylene. Nonwovens were produced on a commercial airlaid line using technology from Dan-Web, Denmark, the nonwovens having a basis weight of about 80 g/m$^2$, a thickness of about 1 mm, and weight ratio of bicomponent fibres to cellulose fibres of 25:75. Samples with each of the bicomponent fibres were tested at 3 different bonding temperatures, 137, 140 and 143° C.

The sheath composition of the individual fibres was as follows:

6: 5% grafted LLDPE (5% maleic acid grafted onto 95% LLDPE), 95% LLDPE.
7: 5% grafted LLDPE (5% maleic acid grafted onto 95% LLDPE), 95% HDPE.
8: 10% grafted LLDPE (5% maleic acid grafted onto 95% LLDPE), 90% HDPE.
9: 12.5% grafted LLDPE (5% maleic acid grafted onto 95% LLDPE), 87.5% HDPE.
10. 13% grafted LLDPE (5% maleic acid grafted onto 95% LLDPE), 87% HDPE.

As a control, AL-Special-C from Danaklon A/S (polypropylene core, HDPE sheath; No. 3 above), was used.

The wet and dry tensile strength and the elongation of the various nonwovens was tested. As the results below show, the nonwovens containing the fibres of the invention showed a substantially improved dry and wet tensile strength compared to the control nonwovens. In addition, some of the fibres of the invention, notably Nos. 6, 7 and 8, showed elongation values above those of the control fibres, while fibre 10 and to a certain extent fibre 9 showed elongation values lower than for the control fibres. The suboptimal results for fibres 9 and 10 in terms of elongation are believed to be related to the fact that some difficulties were experienced in spinning these fibres with a relatively large amount of the grafted component in the sheath. It is believed that with further tests and optimisation of the spinning process and other process parameters, it will be possible to obtain improved results for these and other fibres with a relatively large content of the grafted polyolefin component as well.

| Bonding | | Fibre No. | | | | |
|---|---|---|---|---|---|---|
| Temp. ° C. | Control | 6 | 7 | 8 | 9 | 10 |
| | | Tensile strength, dry (N/5 cm) | | | | |
| 137 | 8.54 | 21.58 | 17.65 | 16.91 | 18.68 | 12.75 |
| 140 | 9.85 | 18.58 | 20.98 | 17.00 | 17.95 | 14.40 |
| 143 | 8.53 | 18.59 | 19.25 | 30.63 | 18.18 | 16.38 |
| | | Elongation, dry (%) | | | | |
| 137 | 185.25 | 190.25 | 154.50 | 199.67 | 174.25 | 133.50 |
| 140 | 175.00 | 184.75 | 188.25 | 195.67 | 169.00 | 119.00 |
| 143 | 178.67 | 189.25 | 185.78 | 184.25 | 185.75 | 144.75 |
| | | Tensile strength, wet (N/5 cm) | | | | |
| 137 | 8.24 | 17.57 | 15.21 | 16.03 | 17.11 | 9.39 |
| 140 | 9.32 | 13.64 | 17 | 13.78 | 16.31 | 10.19 |
| 143 | 8.01 | 15.34 | 15.2 | 24.08 | 17.04 | 16.31 |
| | | Elongation, wet (%) | | | | |
| 137 | 175.25 | 220.75 | 161.50 | 179.67 | 205.25 | 118.75 |
| 140 | 159.50 | 194.25 | 177.75 | 186.75 | 189.00 | 132.50 |
| 143 | 142.50 | 196.00 | 179.67 | 177.00 | 188.50 | 123.75 |

A visual assessment of the dust properties of the nonwovens indicated that all of the tested bicomponent fibres of the invention had an improved bonding to the cellulose fibres compared to the control bicomponent fibres. Fibres 7 and 8 ran particularly well on the production line, and, as the results above show, excellent strength values were also obtained for nonwovens containing these fibres.

The results of the fibres of this example in the dust test were as follows (fibre 10 was not tested):

| Fibre number | Dust (mg) |
|---|---|
| 6 | 6.6 |
| 7 | 14.9 |
| 8 | 5.8 |
| 9 | 6.7 |
| Control | 29.9 |

It can be concluded from the above that good results were obtained with all levels of additive addition, although there appeared to be a tendency for better results with additions of about 5–10%.

We claim:

1. A drylaid nonwoven material comprising bicomponent fibres each fibre comprising:

A) a high melting polyolefin component; and

B) a low melting polyolefin component 1) having a melting point at least 4° C. lower than the melting point of said high melting polyolefin component, 2) constituting at least a part of the surface of said bicomponent fibre, and 3) comprising a non-grafted polyolefin component and a grafted polyolefin component a) wherein said grafted polyolefin component has been grafted with an unsaturated dicarboxylic acid or an anhydride thereof.

2. A drylaid nonwoven material according to claim 1 wherein the grafted polyolefin component of the bicomponent fibres has been grafted with a compound selected from the group consisting of: maleic acid, maleic anhydride and derivatives thereof; fumaric acid and derivatives thereof; unsaturated derivatives of malonic acid; and unsaturated derivatives of succinic acid.

3. A drylaid nonwoven material according to claim 2 wherein the grafted polyolefin component of the bicomponent fibres has been grafted with a compound selected from the group consisting of citraconic acid, citraconic anhydride, pyrocinchonic anhydride, 3-butene-1,1-dicarboxylic acid, benzylidene malonic acid, isopropylidene malonic acid, itaconic acid and itaconic anhydride.

4. A drylaid nonwoven material according to claim 2 wherein the grafted polyolefin component of the bicomponent fibres has been grafted with maleic acid or maleic anhydride.

5. A drylaid nonwoven material according to claim 1 wherein the bicomponent fibres are sheath-core fibres in which the lower melting polyolefin component constitutes the sheath and the high melting polyolefin component constitutes the core.

6. A drylaid nonwoven material according to claim 1 which further comprises at least one additional fibrous material.

7. A drylaid nonwoven material according to claim 6 wherein the additional fibrous material is selected from the group consisting of cellulose fibres, viscose fibres and Lyocell fibres.

8. A drylaid nonwoven material according to claim 6 wherein the additional fibrous material comprises cellulose fluff pulp fibres.

9. A drylaid nonwoven material according to claim 1 wherein the high melting polyolefin component comprises polypropylene and the low melting polyolefin component comprises at least one polyolefin selected from LLDPE, HDPE and LDPE.

10. A drylaid nonwoven material according to claim 1 wherein the difference in melting points between the low melting component and the high melting component of the bicomponent fibres is at least about 20° C.

11. A drylaid nonwoven material according to claim 1 wherein the high melting polyolefin component comprises a first polypropylene, and the low melting polyolefin component comprises a second polypropylene or a polypropylene copolymer with a melting point at least 5° C. lower than the first polypropylene.

12. A method for producing a drylaid nonwoven material, comprising forming a fibrous web using dry lay nonwoven equipment, the web comprising bicomponent fibres each fibre comprising:

A) a high melting polyolefin component; and

B) a low melting polyolefin component 1) having a melting point at least 4° C. lower than the melting point of said high melting polyolefin component, 2) constituting at least a part of the surface of said biocomponent fibre, and 3) comprising a non-grafted polyolefin component and a grafted polyolefin component a) wherein said grafted polyolefin component has been grafted with an unsaturated dicarboxylic acid or an anhydride thereof, and bonding the fibrous web to result in the drylaid non woven material.

13. A method according to claim 12, wherein the fibrous web further comprises at least one additional fibrous material.

14. A method according to claim 13 wherein the additional fibrous material is selected from the group consisting of cellulose fibres, viscose fibres and Lyocell fibres.

15. A method according to claim 13 wherein the additional fibrous material comprises cellulose fluff pulp fibres.

16. A method according to claim 12 wherein the grafted polyolefin component of the bicomponent fibres has been grafted with a compound selected from the group consisting of: maleic acid, maleic anhydride and derivatives thereof; fumaric acid and derivatives thereof; unsaturated derivatives of malonic acid; and unsaturated derivatives of succinic acid.

17. A method according to claim 16 wherein the grafted polyolefin component of the bicomponent fibres has been grafted with a compound selected from citraconic acid, citraconic anhydride, pyrocinchonic anhydride, 3-butene-1, 1-dicarboxylic acid, benzylidene malonic acid, isopropylidene malonic acid, itaconic acid and itaconic anhydride.

18. A method according to claim 16 wherein the grafted polyolefin component of the bicomponent fibres has been grafted with maleic acid or maleic anhydride.

19. A method according to claim 12 wherein the bicomponent fibres are sheath-core fibres in which the lower melting polyolefin component constitutes the sheath and the high melting polyolefin component constitutes the core.

20. A method according to claim 12 wherein the high melting polyolefin component comprises polypropylene and the low melting polyolefin component comprises at least one polyolefin selected from LLDPE, HDPE and LDPE.

21. A method according to claim 12 wherein the difference in melting points between the low melting component and the high melting component of the bicomponent fibres is at least about 20° C.

22. A method according to claim 12 wherein the high melting polyolefin component comprises a first polypropylene and the low melting polyolefin component comprises a second polypropylene or a polypropylene copolymer with a melting point at least 5° C. lower than the first polypropylene.

23. A bicomponent fibre for the production of drylaid nonwoven materials, the fibre comprising:

A) a high melting polyolefin component; and

B) a low melting polyolefin component 1) having a melting point at least 4° C. lower than the melting point of said high melting polyolefin component, 2) constituting at least a part of the surface of said biocomponent fibre, and 3) comprising a non-grafted polyolefin component and a grafted polyolefin component a) wherein said grafted polyolefin component has been grafted with an unsaturated dicarboxylic acid or an anhydride thereof.

24. A drylaid nonwoven material comprising bicomponent synthetic fibres and a natural or regenerated fibrous material, each bicomponent fibre comprising:

A) a high melting polyolefin component; and

B) a low melting polyolefin component 1) having a melting point at least 4° C. lower than the melting point of said high melting polyolefin component 2) constituting at least a part of the surface of said biocomponent fibre, wherein the bicomponent fibres having a bonding affinity to the natural or regenerated fibres such that the nonwoven material shows a dust value in the standardised dust test described herein of not more than about 10 mg.

* * * * *